United States Patent [19]

Stasiek et al.

[11] Patent Number: 4,558,601

[45] Date of Patent: Dec. 17, 1985

[54] DIGITAL INDICATING TORQUE WRENCH

[75] Inventors: Jan S. Stasiek, Atlanta, Ga.; Ira Deyhimy, Thousand Oaks, Calif.

[73] Assignee: J. S. Technology, Inc., Alpharetta, Ga.

[21] Appl. No.: 568,782

[22] Filed: Jan. 6, 1984

[51] Int. Cl.[4] ..... B25B 23/142

[52] U.S. Cl. ..... 73/862.23; 73/1 C; 73/862.26

[58] Field of Search ..... 73/862.08, 862.21–862.24, 73/862.26, 862.33, 1 C; 250/237 G

[56] References Cited

U.S. PATENT DOCUMENTS

| | | | |
|---|---|---|---|
| D. 244,829 | 6/1977 | Lehoczky et al. . | |
| 1,728,552 | 9/1929 | Kennedy et al. . | |
| 2,063,622 | 12/1936 | Pfeiffer . | |
| 2,125,945 | 8/1938 | Montgomery . | |
| 2,159,354 | 5/1939 | Dunn | 73/862.26 |
| 2,174,356 | 9/1939 | Zimmerman . | |
| 2,201,234 | 5/1940 | Kress . | |
| 2,303,411 | 12/1942 | Van Horn . | |
| 2,367,224 | 1/1945 | Larson et al. . | |
| 2,442,359 | 6/1948 | Hattan . | |
| 3,114,046 | 12/1963 | Cabaniss et al. | 250/237 G |
| 3,475,953 | 11/1969 | Larson . | |
| 3,688,570 | 9/1972 | Burke, Jr. | 250/237 G X |
| 3,726,134 | 4/1973 | Grabovac . | |
| 3,726,135 | 4/1973 | Vuceta . | |
| 4,026,369 | 5/1977 | Vliet | 73/862.33 X |
| 4,125,016 | 11/1978 | Lehoczky et al. . | |

FOREIGN PATENT DOCUMENTS

| | | | |
|---|---|---|---|
| 2651636 | 5/1978 | Fed. Rep. of Germany | 73/862.26 |

OTHER PUBLICATIONS

Oligashi et al.–"A New Electronic Device for Measuring Torque", *SAE Transactions*, vol. 74, 1966, pp. 226–235.

"Manual Wrench Tightens Accurately", *Design News* 2/7/83.

*Primary Examiner*—Charles A. Ruehl

*Attorney, Agent, or Firm*—Jones & Askew

[57] ABSTRACT

A digital indicating torque wrench comprising a shaft having a high modulus of elasticity and including a handle at one end, and an elongate actuating arm including a free end which moves with respect to the shaft in response to the application of torque to a workpiece. Displacement measuring means comprising an optical encoder measures the relative movement between the actuating arm and the shaft and provides deflection signals which are related to the amount of relative movement. A programmed microcomputer responsive to the deflection signals converts the amount of deflection into signals representing the amount of torque applied to the workpiece, and displays a visual representation of the applied torque.

33 Claims, 22 Drawing Figures

BCD DECODER
μC
PORT 1
PORT 2-5
PORT 2-4
PORT 2-7
PORT 2-6
INT
TO
INT CLR
D
OFF
MODE
ON/RST
SET
UNITS
ON
BUZZ
MATCH LINE
CONT
PEAK
PRESET
FT-LBS
NT-M
KG-M
+5V

MAIN PROGRAM

INTERRUPT ROUTINE (INT)

FRONT PANEL ROUTINE

CONTINUOUS MODE (CONT)

PEAK HOLD MODE (PKHOLD)

DIGITAL INDICATING TORQUE WRENCH

TECHNICAL FIELD

The present invention relates generally to torque wrenches, and relates more particularly to a digital indicating torque wrench which provides a direct numerical readout of the amount of torque applied to a workpiece.

BACKGROUND

Indicating torque wrenches are known in the art, and include deflection beam and dial indicating wrenches. Recently, electronic techniques have been applied to improve the convenience and usefulness of conventional torque wrenches. The patent to Lehoczky et al., U.S. Pat. No. 4,125,016 discloses an electronic strain-gauge torque wrench which purports to provide increased accuracy by use of electronic means for sensing and displaying the applied torque. An analog signal representing the applied torque is produced by strain-sensitive foil-type resistors. This analog signal is converted into digital signals by an iterative process, and a difference or error signal is created for incrementing or decrementing a stored count until the difference signal is reduced to zero. The stored count then is a digital representation of the applied torque.

Since the analog signal is obtained via a resistive bridge network which includes the strain-sensitive resistive elements, offsets or inaccuracies are introduced due to nonlinearities in the resistors, temperature variations, and other error-introducing factors.

In particular, use of the Lehoczky device in one direction, such as clockwise for repeatedly tightening bolts, may introduce a permanent offset due to the fact that one of the strain sensitive resistors will have been repetitively placed in a compression mode while the other of the strain sensitive resistors will have been placed in an extensive mode. A permanent offset of this nature can only be corrected by rebalancing the resistive bridge. Consequently, after each application and release of torque, there is no assurance that the reading will be zero unless steps are taken to re-balance the bridge to compensate for any growing permanent offset.

Another problem with the Lehoczky torque wrench is calibrating the device to ensure that the displayed torque is an accurate representation of the applied torque. In the construction of torque wrenches, there are always some variations in the parameters of the elements which require compensation, such as modulus of elasticity of the handle or the characteristics of the electronic devices.

The Lehoczky device is calibrated by adjustment of a potentiometer which is apparently only usable for full scale calibration. The use of a potentiometer for calibration, together with the heavy reliance of analog circuit techniques, makes the Lehoczky device susceptible to thermal drift.

SUMMARY OF THE INVENTION

The present invention provides a digital indicating torque wrench which seeks to overcome many of the difficulties encountered with strain gauge type torque wrenches. Briefly described, the present invention comprises a digital indicating torque wrench including a handle, a socket, stem, or other device for converting a force applied to the handle into a torque applied to a workpiece, an actuating arm having a free end which is movable with respect to the handle upon application of torque to the workpiece, and circuitry for measuring the displacement between the actuating arm and the handle so as to provide displacement signals related to the movement of the actuating arm. A programmed digital computer is provided for receiving the displacement signals and for converting these received signals into a series of digital signals having a magnitude related to the amount of torque applied to the workpiece. A digital display connected to the computer provides a visual readout of the amount of torque.

In particular, optical encoder means are employed in the preferred embodiment to detect the movement of the actuating arm. One end of the actuating arm is rigidly mounted to the wrench near the socket or stem portion of the wrench, while the opposite, free end is received within the housing which supports the circuitry employed in the preferred embodiment. Affixed to the free end of the actuating arm is a transparent movable scale or reticle bearing a plurality of indicia which form a grating pattern. A fixed transparent scale or reticle having a similar grating pattern is positioned in an overlapping relationship with the movable scale. A light source mounted within the housing provides light through both the fixed scale and the movable scale. A light detector is mounted to detect light emitted by the light source and passing through both the fixed and the movable scales.

As the handle deflects during the application of torque, causing relative movement of the actuating arm, the grating patterns of the fixed and movable scales produce alternating opaque and transparent areas in the light path between the light source and the light detector. Circuitry connected to the light detector provides pulses representing increments of displacement upon the detection of the opaque and transparent areas.

An advantage of the present invention is that a self-zeroing function is provided on each power-up or actuation of a reset switch. The programmed computer than assigns zero torque to the current position of the scales, so that any subsequent relative movement between the fixed and movable scales indicates the application of torque. Frequently, when a torque wrench is used in opposite directions, such as by loosening a nut after tightening one, a number will be displayed even when no torque is applied because of the hysteresis effect. Displaying zero torque on power-up or reset eliminates this annoying display of a number when no torque is applied.

Another feature of the present invention is that different systems of units, such as newton-meters, kilogram-meters, or foot-pounds, can be selected, depending upon the preference of the operator. The device can be set to one of three different modes—a continuous mode, a peak mode and a preset mode. In the continuous mode, there is provided a continuous display of the amount of torque applied. In the peak mode, the display maintains the highest reading of torque measured since the beginning of a particular event. In the preset mode, a buzzer provides an audible signal that a preset limit has been exceeded. The preset limit is entered by placing the device into a "set" mode wherein the digits on the display are selectable to indicate the desired point at which the alarm should sound.

Still another advantage of the present invention is that the device may be calibrated quickly and conveniently upon the application of a known torque by use of digital calibration switches. Compensation for variations in the modulus of elasticity of the handle or offsets in the electronic components is provided by selecting a digital correction or calibration value when the wrench is assembled. The preferred embodiment consequently relies more heavily on digital techniques than many prior art devices.

Accordingly, it is an object of the present invention to provide an improved digital indicating torque wrench.

It is another object of the present invention to provide a digital indicating torque wrench which does not employ a strain gauge approach for measuring the torque.

It is another object of the present invention to provide a digital indicating torque wrench which automatically zeros itself on power up or resetting, so as to nullify the effects of hysteresis caused by use of the wrench in opposite directions.

It is another object of the present invention to provide digital indicating torque wrench which measures the torque applied by digital techniques through the use of an optical encoder, as opposed to analog techniques which are more subject to thermal drift, offset and other problems frequently encountered in analog circuitry.

It is another object of the present invention to provide in a digital indicating torque wrench a variety of modes of operation including a peak mode which maintains the display of the highest torque recorded, a preset or alarm mode wherein an alarm signal is provided when a predetermined torque has been reached, and a continuous mode wherein the instantaneous torque applied is displayed.

These and other, objects, features, and advantages of the present invention may be more clearly understood and appreciated from a review of the following detailed description of the disclosed embodiment and by reference to the appended drawings and claims.

BRIEF DESCRIPTION

DETAILED DESCRIPTION OF THE PREFERRED EMBODIMENT

Figures 1, 2, 3:
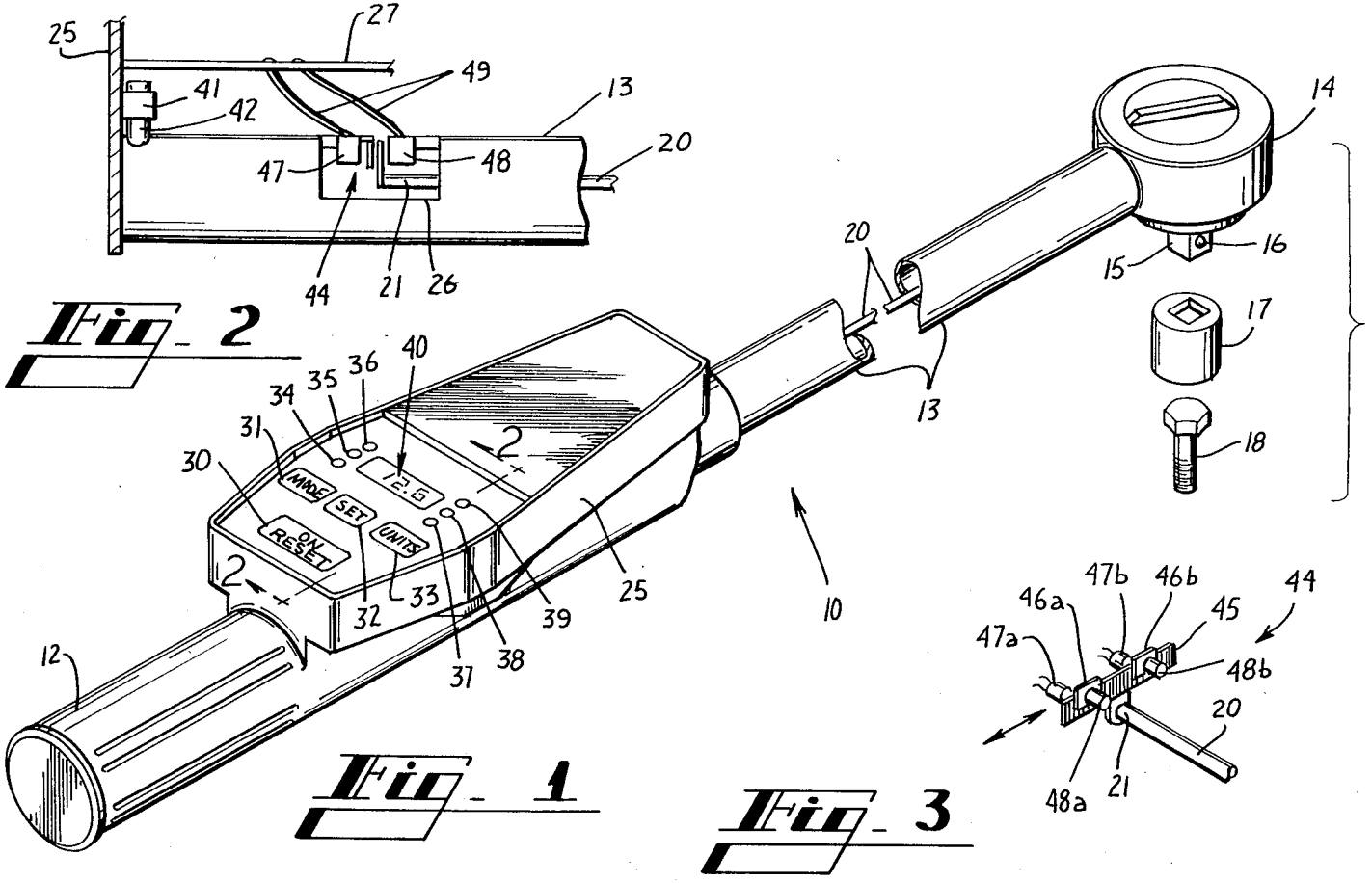
FIG. 1 is a pictorial view of the preferred embodiment of the present invention.
FIG. 2 is a partial cross-sectional view taken along the line 2—2 of the wrench shown in FIG. 1.
FIG. 3 is a partial pictorial view of the optical encoder employed in the preferred embodiment.

Referring now to the drawings, in which like numerals indicate like elements throughout the several views, FIG. 1 shows a digital indicating torque wrench 10 constructed in accordance with the present invention. The preferred embodiment includes a conventional handle 12 for gripping, an elastic hollow elongate deflecting shaft 13 rigidly connected to the handle for leveraging, and a cylindrical head 14 including a stem 15 provided with a spring loaded retaining ball 16 in one of its faces to facilitate releasably holding a socket 17 or the like. The shaft 13 preferably has a high modulus of elasticity, for example on the order of $3\times10$ p.s.i.

Rigidly attached to the head 14 and contained within the shaft 13 is an elongate fixed indicating or actuating arm 20 which is preferably of uniform cross-section of predetermined longitudinal and diametric extent. The actuating arm 20 includes a free end 21, seen in FIG. 2, which moves relative to the shaft 13 when torque is applied. The actuating arm 20 is mounted in the head 14 in a conventional manner such as by drilling and tapping the head to receive threads on the actuating arm.

A rotatable housing 25 encloses the circuitry employed in the preferred embodiment to detect the movement of the free end 21 of the actuating arm 20, and to convert this movement into signals representative of the applied torque which may then be displayed. As seen in FIG. 2, the hollow shaft 13 includes a cut-out portion 26 through which the free end 21 of the actuating arm 20 extends and which allows movement of the free end with respect to the shaft 13. Batteries 23 provide power for portable operation, and are removably contained within housing 25.

A circuit board 27 for mounting the electronic components is also enclosed within the housing 25. The circuit board mounts several switches for controlling the device, status display lamps, and a digital display readout. A switch 30 labelled "ON/RST" controls the power on and reset functions. A "MODE" switch 31 controls whether the device is in the continuous, peak, or preset modes. A "SET" switch 32 controls the cycling of the digits so as to preset a torque value for use in the "preset" mode. A "UNITS" switch 33 controls whether the displayed torque value is in foot-pounds, newton-meters, or kilogram-meters. Mode light emitting devices (LED's) 34, 35, and 36, only one of which is lit at a given time, display whether the device is in the continuous, peak, or preset modes respectively.

A three-digit digital display readout 40 including decimal point for display of the amount of torque is also mounted in the housing 25. Units LED's 37, 38, and 39 display whether the units displayed are in foot-pounds, newton-meters, or kilogram-meters.

The housing 25 is rotatable 180 degrees about the shaft 13 so that the readout 40 can be easily seen when both tightening and loosening. Stops 41, 42 are provided to limit the rotation to protect internal wiring.

Since it is known that the application of a known force to a shaft having a known length and modulus of elasticity will produce a deflection proportional to the force and hence to the torque applied by the head 14, the present invention is provided with displacement measuring means 44 (FIGS. 2 and 3) for measuring this deflection. In the preferred embodiment, the displacement measuring means includes a fixed portion and a movable portion responsive to move a predetermined distance with respect to the fixed portion upon the application of a predetermined force to the handle 12.

Figure 4:
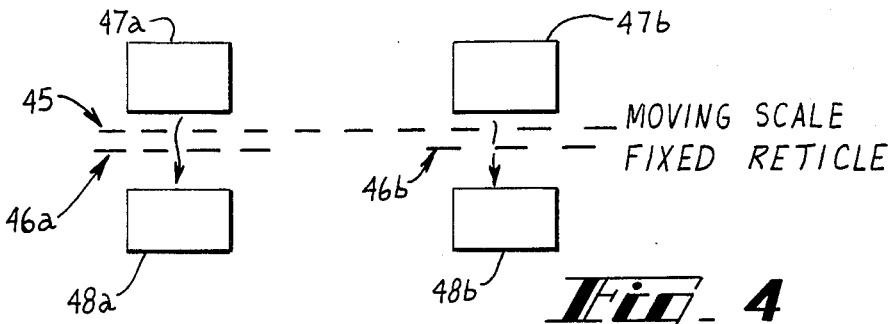
FIG. 4 is a diagram illustrating the placement of the fixed and movable scales employed in the optical encoder.

The displacement measuring means 44 of the preferred embodiment comprises an optical encoder which produces a plurality of pulses, each pulse representing an incremental amount of displacement between the fixed and movable portions. The movable portion of the optical encoder comprises a reticle or scale 45 which is affixed via a screw or the like to the free end 21 of the actuating arm 20. The fixed portion of the optical encoder comprises a pair of fixed reticles 46*a*, 46*b* which are mounted within the shaft 13 such that the grating patterns thereon are offset by a half-cycle, as shown in FIG. 4. The movable scale 45 and the fixed reticles 46*a*, 46*b* are positioned in overlapping relation.

Light emitting diodes 47*a*, 47*b* are mounted within the shaft 13 so as to pass light through the movable scale and through the overlapping fixed reticles. A pair of photodetectors 48*a*, 48*b* are also mounted within the shaft 13 in the path of light emitted by the LED's 47*a*, 47*b* so as to detect light which passes through both the movable scale 45 and the adjacent fixed reticles 46*a*, 46*b*. Wires 49 connect the LED's 47*a*, 47*b* and photodetectors 48*a*, 48*b* to the circuit board 27.

Figure 5:
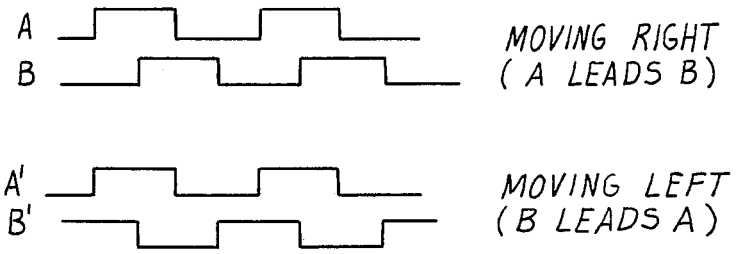
FIGS. 5 and 6 are timing or wave form diagrams showing the outputs of the optical encoder circuitry.

As illustrated in FIG. 4, the grating pattern on the fixed and movable reticles forms a bi-phase optical encoder. It will be appreciated that such an optical encoder produces signals which may be analyzed so that the direction of movement of the moving scale with respect to the fixed reticles can be determined. This determination is made by analyzing the signals produced by the photodetectors 48*a*, 48*b*. Since the fixed reticles 46*a*, 46*b* are mounted a half cycle offset with respect to one another, the light incident upon the photodetectors 48*a*, 48*b* produces signals A and B, respectively, which have a ninety degree phase difference at all times. As illustrated in FIG. 5, when the moving scale is moving to the right, the signal A will lead the signal B by 90 degrees, but when moving left, the signal B will lead signal A by 90 degrees. By detecting the signals A and B produced by photodetectors 48*a*, 48*b*, the direction and fact of displacement is detected.

Figure 6:
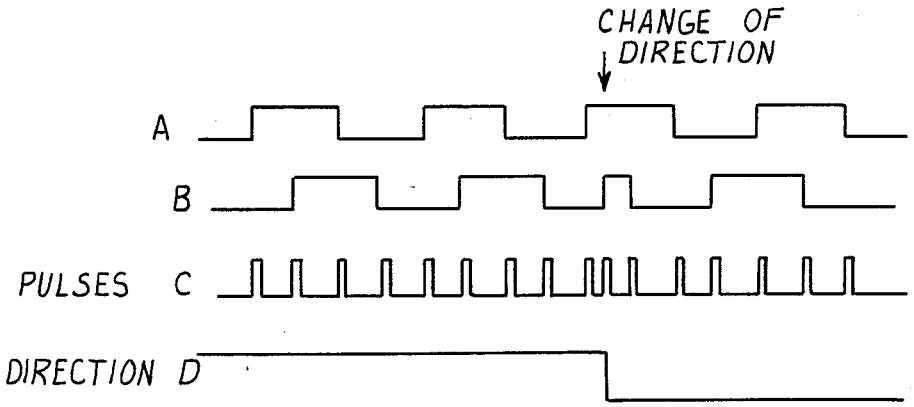

In the preferred embodiment, each transition of the signal A or B produces a pulse signal C, shown in FIG. 6, which represents an increment of displacement. In the preferred embodiment, the spacing between lines of the grating pattern is ½ mils, to detect an increment of displacement of this order. It will be understood, however, that spacings as small as 1/10,000 inch are also contemplated. A direction signal D is also provided which is a logical one when moving in one direction and a logical zero when moving in the opposite direction.

In particular, FIG. 6 illustrates the signals which occur upon a change of direction. It will be appreciated that the direction signal D changes polarity when the bi-phase relationship between the signals A and B changes from A leads B to B leads A. As will be discussed below, the preferred embodiment includes circuitry for detecting each transition of the signals A and B, and for determining the direction of movement.

It will of course be understood that the present invention may be employed in any type of torque-applying tool which determines the torque being applied by measuring the displacement between a fixed portion and a movable portion. FIGS. 7A–7E illustrate the application of the displacement measuring means 44 on various different types of torque-applying tools which rely upon displacement measurement for determination of the applied torque.

Figure 7A:
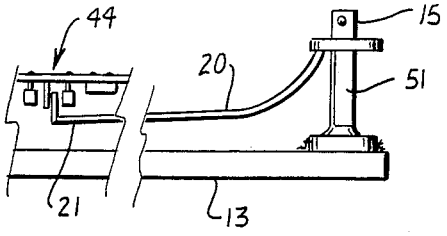
FIGS. 7A–7E illustrate the use of the optical encoder with various types of displacement-measuring torque tools.

For example, FIG. 7A shows a torsion bar type torque wrench wherein the actuating arm 20 is mounted to the upper end of a torsion bar 21, the lower end of which is affixed to the shaft 13 of the wrench. The free end 21 of the actuating arm 20 has attached thereto the movable reticle. It will be understood that application of torque to the stem 15 results in a twisting of the torsion bar 51, resulting in displacement of the free end 21.

Figure 7B:
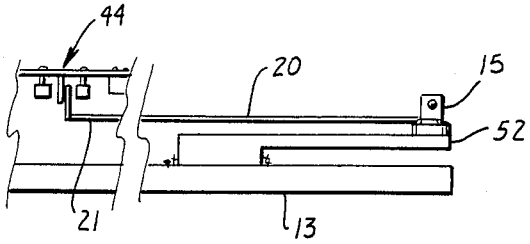
Figure 7C:
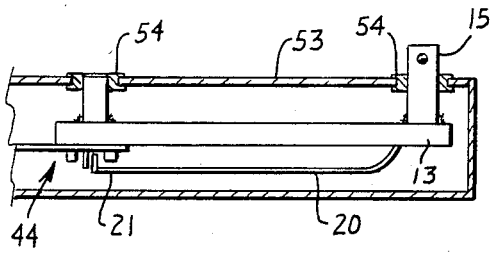

FIG. 7B illustrates a cantilever beam type torque wrench wherein the actuating arm 20 and the stem 15 are affixed to a cantilever beam 52, which in turn is attached to the shaft 13 of the wrench. The displacement measuring means 44 is mounted in the proximity of the free end 21 of the actuating arm 20. FIG. 7C illustrates the enclosed bending beam type torque wrench, which comprises a hollow tubular handle 53 which encloses the shaft 13 and supports the shaft at bushings 54. The actuating arm 20 is attached to the shaft 13 near the stem 15, and the free end 21 of the actuating arm 20 moves relative to the shaft 13. The displacement measuring means 44 is mounted to be operative with the free end 21.

Figure 7D:
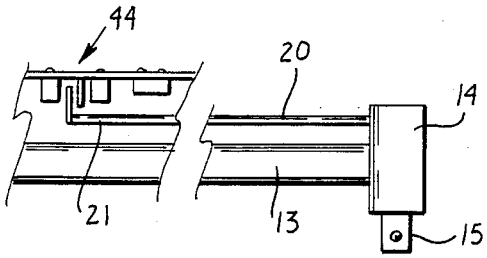

FIG. 7D illustrates a conventional deflection beam type torque wrench wherein the free end 21 of the actuating arm 20 is movable with respect to the shaft 13.

Figure 7E:
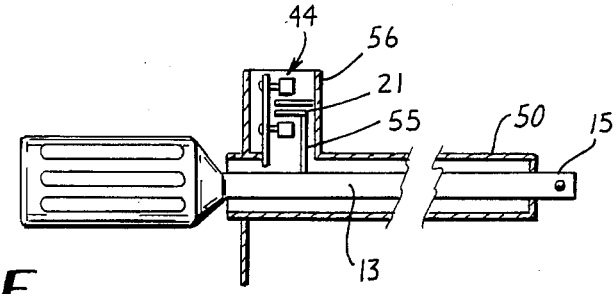

FIG. 7E illustrates a torque screwdriver wherein the deflection measuring means 44 measures the movement between the free end 21 of an indicator rod or pointer 55 and a housing 56 which contains the shaft 13. The pointer 55 is rigidly attached to the shaft and moves as torque is applied to the handle 12.

Figure 8A:
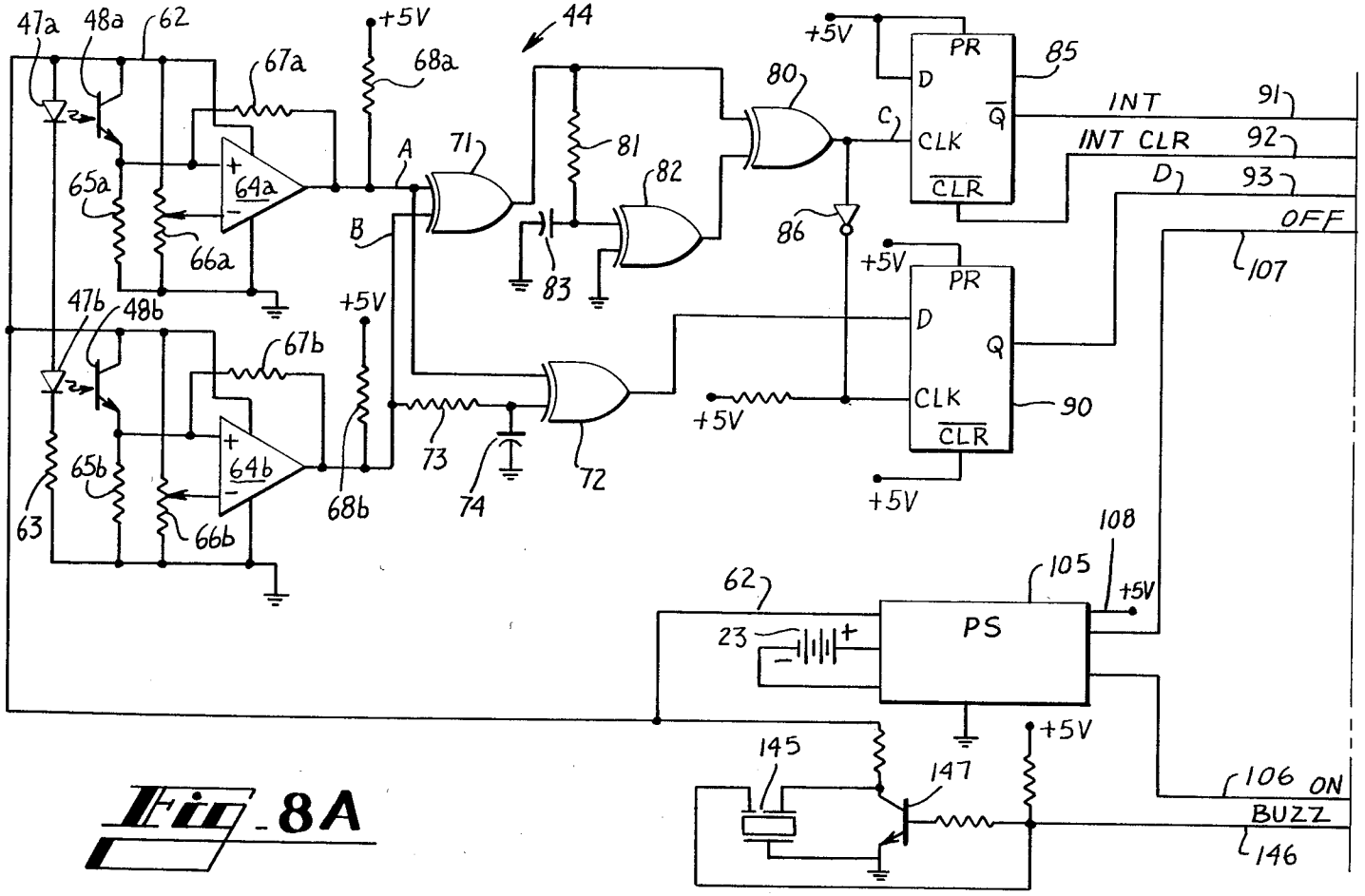
FIGS. 8A–8B are a schematic diagram of the circuitry employed in the preferred embodiment.
Figure 8B:
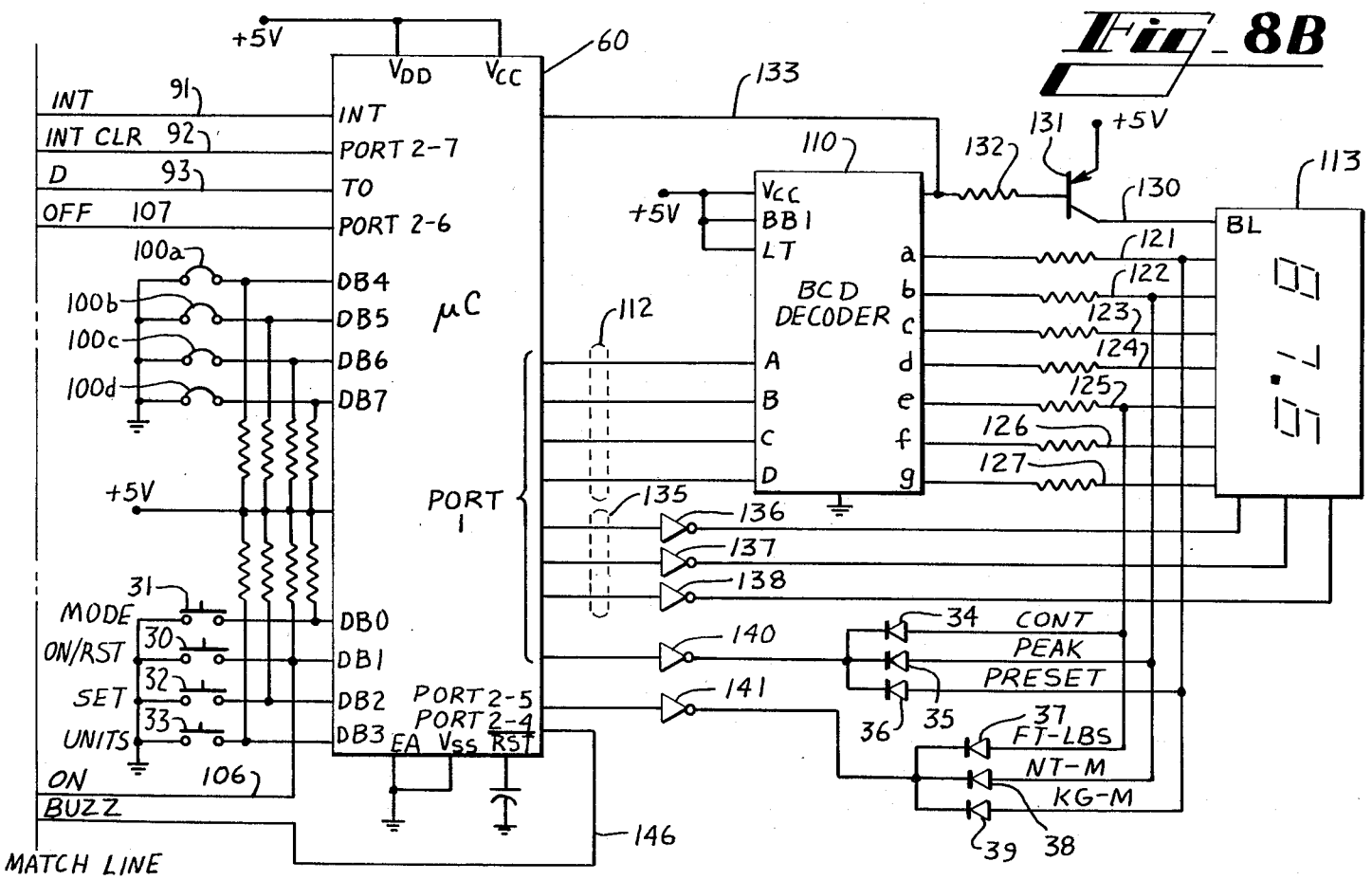

Turning now to FIGS. 8A–8B, a programmed digital microcomputer 60 is employed in the preferred embodiment to receive the signals A and B from the displacement measuring means 44, as well as the pulse signal C and the direction signal D. The preferred microcomputer circuit is a type 8048 single chip eight-bit microcomputer manufactured by INTEL Corporation, Santa Clara, Calif. It will of course be appreciated that others of the 8048 family of microcomputers such a the type 8035 or 8748 can also be employed, as well as other types of microcomputers by other manufacturers with equal success.

Microcomputer 60 receives the signals generated by the movement of moving scale 45 and converts these signals into a binary coded decimal (BCD) number for display. The signals A, B, C, and D are generated as follows. Light from LED's 47*a*, 47*b*, passes through the moving scale 45 and the fixed recticles 46*a*, 46*b*, and is detected by photodetectors 48*a*, 48*b*. The anodes of the LED's 47*a*, 47*b* are connected in series to the power supply on line 62 and through a current-limiting resistor 63 to ground. Accordingly, when power is provided on line 62, light will be emitted by the LED's.

Light is detected by the movement of the moving scale and converted into electrical signals by photodetectors 48*a*, 48*b* and amplified by amplifiers 64*a*, 64*b*. The preferred embodiment uses type LM339 operational amplifiers (op amp) manufactured by National Semiconductor Corporation. For photodetector 48*a*, the collector of the photo detector is connected to the power supply line 62, while the emitter is connected to the noninverting input of op amp 64*a* and through a current-limiting resistor 65*a* to ground. The inverting input of op amp 64*a* is connected to the wiper of a potentiometer 66*a* (for offset adjustment), whose terminals are connected between the power supply line 62 and ground. A feedback resistor 67*a* is connected between the output of op amp 64*a* and the noninverting input. The output is also pulled up through resistor 68*a* to the five volt power supply. There accordingly appears at the output of op amp 64*a* the signal A which has the wave form as shown in FIG. 5. It will be appreciated that similar circuitry connected to op amp 64b provides the signal B.

The bi-phase signals A and B are next connected to circuitry which provides the pulse signal C and the direction signal D. The signal A is connected to one of the inputs of each of exclusive-OR gates 71 and 72. The signal B is connected through a delay network comprising resistor 73 and capacitor 74 to the other input of exclusive OR-gate 72, and is connected directly to the other input of exclusive OR-gate 71. The output of exclusive OR-gate 71 is connected to the input of a third exclusive-OR gate 80. The output of exclusive-OR gate 71 is also connected through a delay network comprising resistor 81 and capacitor 83 to one of the inputs of a fourth exclusive-OR gate 82. The other input of exclusive-OR gate 82 is grounded, while the output is connected to the other input of exclusive-OR gate 80. It will now be appreciated that the output of exclusive OR gate 80 provides the pulse signal C, and that this signal occurs for each transition, either positive or negative, of either of the signals A or B.

The pulse signal C is connected to the clock input CLK of a D-type flip flop 85, as well as to the input of an inverter circuit 86. The output of inverter 86 is connected to the clock input CLK of a second D-type flip flop 90. It will be appreciated that the rising edge of the pulse signal C clocks flip flop 85 while the trailing edge clocks flip flop 90.

The D input of flip flop 90 is connected to the output of exclusive-OR gate 72. The output Q provided on line 93 is the direction signal D which will be high for movement in one direction and low for movement in the other direction. The direction signal D is connected to the test input line T0 of microcomputer 60. It will be appreciated that microcomputer 60 can then determine the direction of movement by testing under program control the signal on line 93.

The D-type flip flop 85 controls the requesting of an interrupt of microcomputer 60. The D input of flip flop 85 is tied high so that each clock pulse provided by the pulse signal C clocks a "one" into the flip flop. The negated output of flip flop 85 is provided on line 91 to the negated interrupt input INT of microcomputer 60, and comprises the interrupt request signal INT. The clear input of flip flop 85 is connected on line 92 to one of the PORT2 outputs of microcomputer 60, and comprises the interrupt clear siganl INT CLR.

Figure 14:
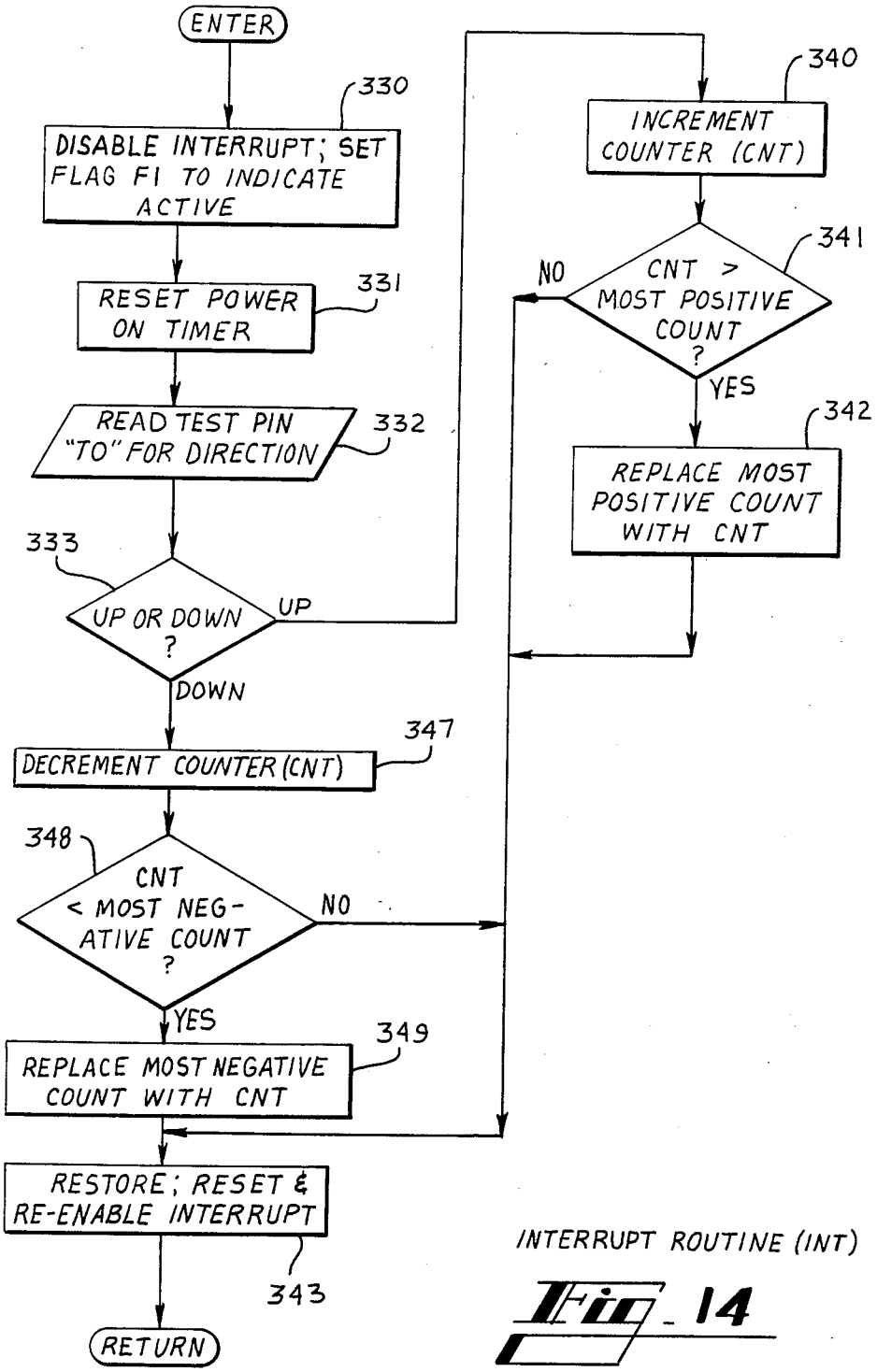

It will be appreciated that each pulse signal C resulting from an incremental movement of the movable scale requests an interrupt of microcomputer 60, thereby causing the execution of the interrupt service routine (FIG. 14). It will also be appreciated that microcomputer 60 under program control clears the interrupt and enables the device to accept and process another increment of movement by providing the interrupt clear signal INT CLR on line 92. It will now be understood that the movement of the moving scale 45 with respect to the fixed reticles 46a, 46b provides signals representative of an increment of movement of the actuating arm 20 with respect to the shaft 13, and that each increment of movement in either of the clockwise or counterclockwise direction can be processed by microcomputer 60 as hereinafter described to convert the movement into a number representative of the applied torque.

Still referring to FIGS. 8A–8B, the data bus lines DB0–DB7 are connected to various jumpers and switches so that a calibration correction value can be provided to microcomputer 60 and control signals may be provided. Lines DB0–DB3 are connected to the MODE switch 31, the ON/RST switch 30, the SET switch 32, and the UNITS switch 33, respectively. One terminal of each of these switches is grounded while the other terminal is pulled up five volts through conventional pull up resistors.

Four calibration jumpers 100a–100d are connected to data bus lines DB4–DB7, respectively. One terminal of each of these jumpers is grounded while the other terminal is pulled up to five volts through conventional pull up resistors. The calibration jumpers 100a–100d are either clipped or left connected in accordance with the amount of correction required to bring the displayed value of torque within an acceptable tolerance of a known amount of torque which is applied to the wrench during calibration. Since there are four calibration jumpers, a total of sixteen discrete levels of calibration are provided in order to provide for plus or minus five percent adjustment capability.

Accordingly, it will be understood that in order to effect plus or minus five percent correction, each of the sixteen possible levels of calibration each represents approximately 0.62 percent adjustment. Calibration is accomplished in the preferred embodiment by applying a known torque and by clipping or leaving intact calibration jumpers 100a–100d as necessary to bring the displayed value as close as possible to the calibration value.

Power is provided to the circuitry in the preferred embodiment in the following manner. Batteries 23 are connected to a power supply circuit 105 which regulates the output of the batteries and provides power at five volts to the various components in the circuitry. Line 106, connected to the ON/RST switch, and also connected to data bus line DB1, provides a signal designated "ON" to the power supply 105 to provide power to the circuit. Actuation of the ON/RST switch causes the power supply to activate, and causes microcomputer 60 to begin program execution. After the program begins running, a signal on data bus line DB1 from the microcomputer holds the power supply on until a timeout routine causes the removal of the signal. This occurs when a signal designated "OFF" on line 107 from one of the PORT2 outputs of microcomputer 60 provides a signal under program control to shut off the power supply. Power is supplied along lines 62 and 108 to various circuit components, with line 108 being the regulated five volt power supply and line 62 being an unregulated power supply. It is within the skill of the art to construct power supply circuitry which operates as described.

As mentioned above, microcomputer 60 converts the movement of moving scale 45 into a BCD number suitable for display. A single BCD decoder circuit 110 receives the four—bit BCD number on lines 112 from four of the PORT1 outputs of microcomputer 60, and converts this BCD number into signals for driving a seven-segment LED display 113. In the preferred embodiment, BCD decoder 110 is a type 74C48 . Display 113 is preferably a type DL-430M manufactured by Litronix Inc., Cupertino, Calif. The seven segment outputs of decoder 110 are provided through current-limiting resistors to the corresponding seven segment inputs of the display 113 on lines 121–127.

The power supply input of display 113 is connected on line 130 to the collector of a PNP transistor 131, whose emitter is connected to the power supply. The base of transistor 131 is connected through a resistor 132 to the blanking input BL of decoder 110, which is also connected to one of the PORT2 outputs of microcomputer 60 on line 133. Those skilled in the art will appreciate that a low on line 133 from microcomputer 60 causes decoder 110 to turn off all seven segments on lines 121–127, as well as removes the power from the display 113, thereby providing means for blanking the display 113 as well as for flashing the display on and off under program control.

Selection of the three digits of the display 113 is made through three of the PORT1 lines 135 from microcomputer 60. Each of the lines 135 is inverted by one of inverters 136–138, which drive the digit selection lines of the display 113.

The mode LED's and the units LED's are driven by decoder 110 by time-multiplexing. Line 125 from decoder 110 is connected to the anodes of both the CONT LED 34 and the FT-LB LED 37. Line 122 is connected to the anodes of both the PEAK LED 35 and the NT-M LED 38. Line 121 is connected to the anodes of both the PRESET LED 36 and the KG-M LED 39. The cathodes of mode LED's 34, 35 and 36 are commonly connected to the output of inverter 140, whose input is connected to one of the PORT1 outputs of microcomputer 60. The cathodes of the units LED's 37, 38, and 39 are commonly connected to the output of inverter 141, whose input is connected to one of the PORT2 outputs of microcomputer 60. At a time when no digits are being displayed on display 113, a particular one of the mode or units LED's may be illuminated by providing signals to the inputs of inverters 140, 141, which will allow current to pass through and illuminate the particular LED which is selected by decoder 110 on lines 121, 122, or 125.

When in the "preset" mode, an audible signal is provided by a buzzer 145 when the applied torque reaches a value which has been preset. A signal on line 146 from one of the PORT2 outputs of the microcomputer drives the base of an NPN driver transistor 147, the emitter of which is grounded and the collector of which is provided to the power supply on line 62. It will be appreciated that a high signal on line 146 forces transistor 147 to conduct and allows current to flow through the buzzer 145, causing the buzzer to emit an audible sound.

The connections for power supply, grounding, and crystal oscillator for microcomputer 60 are conventional and will be known to those skilled in the art.

OPERATION

FIGS. 9–17 are flow diagrams which illustrate the steps that microcomputer 60 takes in the preferred embodiment to accomplish the measurement of the torque applied to a workpiece as represented by the incremental movement of the moving scale 45. It will be understood by those skilled in the art that the flow chart represents a possible series of steps which may be taken to accomplish the objectives of the present invention, and that other sequences of steps may be employed with success in accomplishing such objectives. Furthermore, it will be understood that the diagrams shown in FIGS. 9–17 may be implemented by means of hard-wired logic circuits or programmed logic arrays in place of the microcomputer while still successfully accomplishing the objectives of the invention.

It should first be explained that the disclosed embodiment has three possible modes of operation: (1) a "continuous" mode, wherein the instantaneous torque reading is continuously displayed, (2) a "peak" or "peak hold" mode, wherein the highest torque reading during a period of use is continuously displayed, and (3) a "preset" mode, wherein the display is flashed as the applied torque approaches to within a threshold of a desired preset torque value, and wherein an audible alarm is sounded when the preset torque is reached. Accordingly, it will be understood that various operations and steps are necessary to effectuate and accommodate these modes of operation, as described in detail below.

Figure 9:
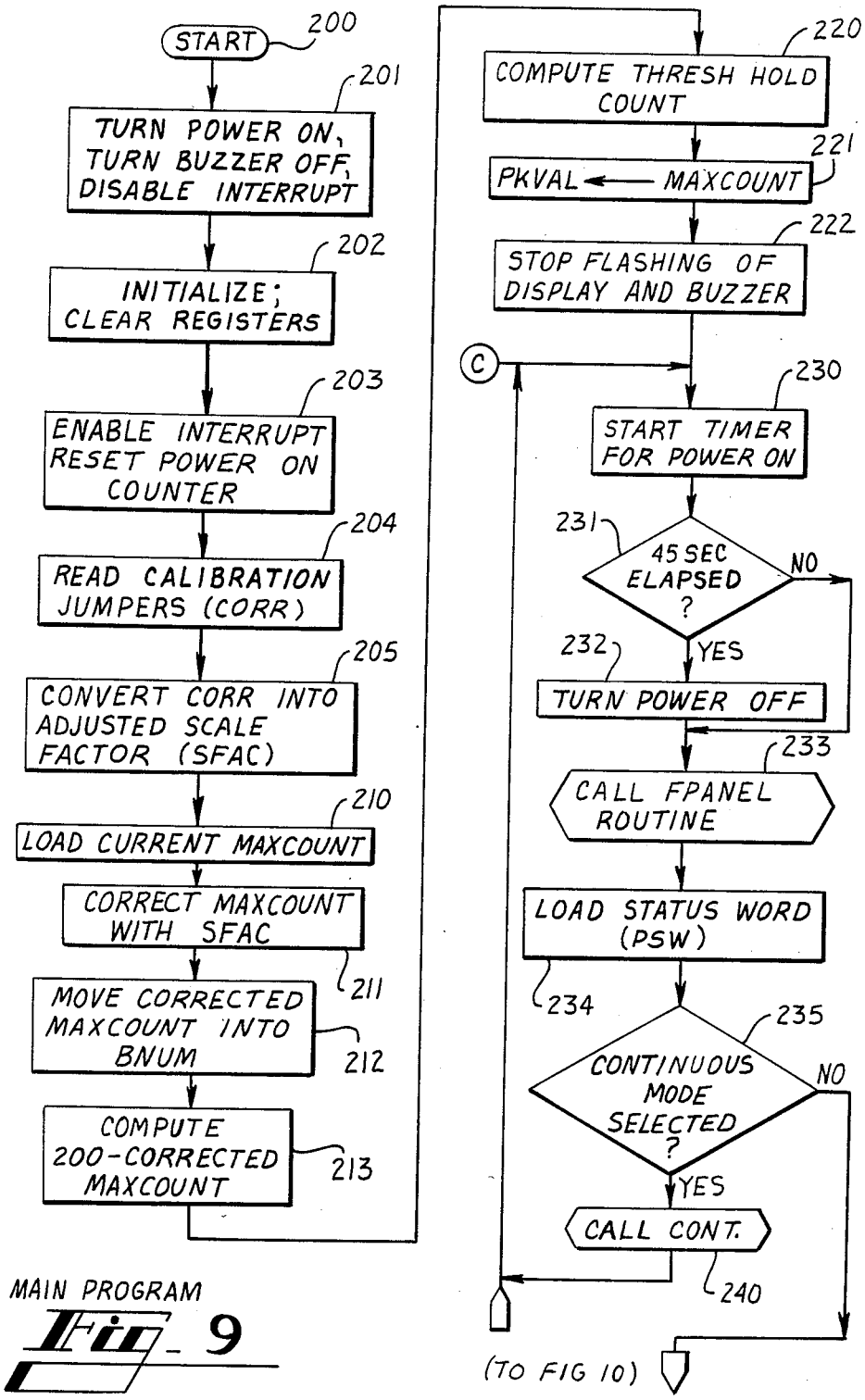
FIGS. 9–17 are flow chart diagrams of the general operation of the preferred embodiment.
Figure 10:
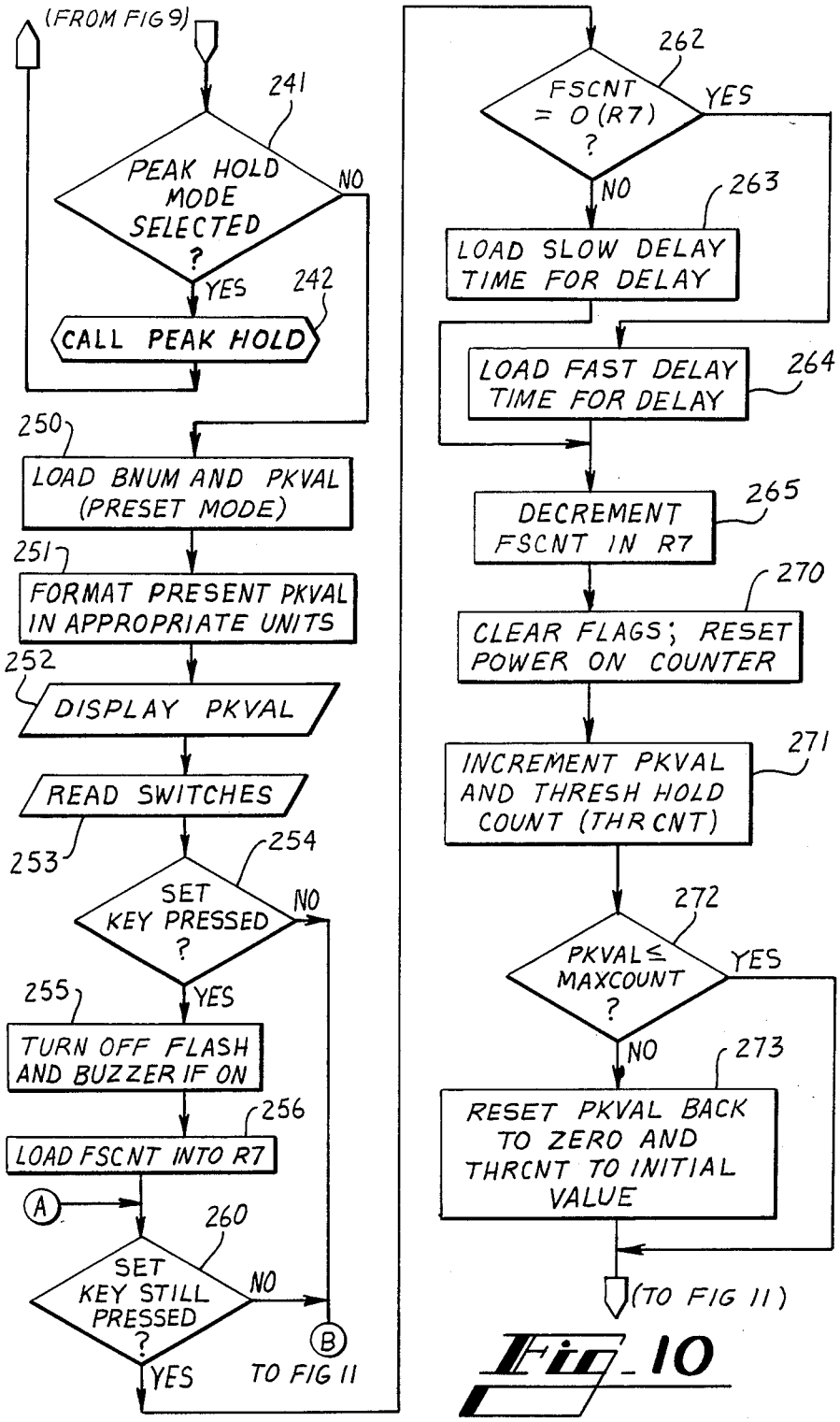
Figure 11:
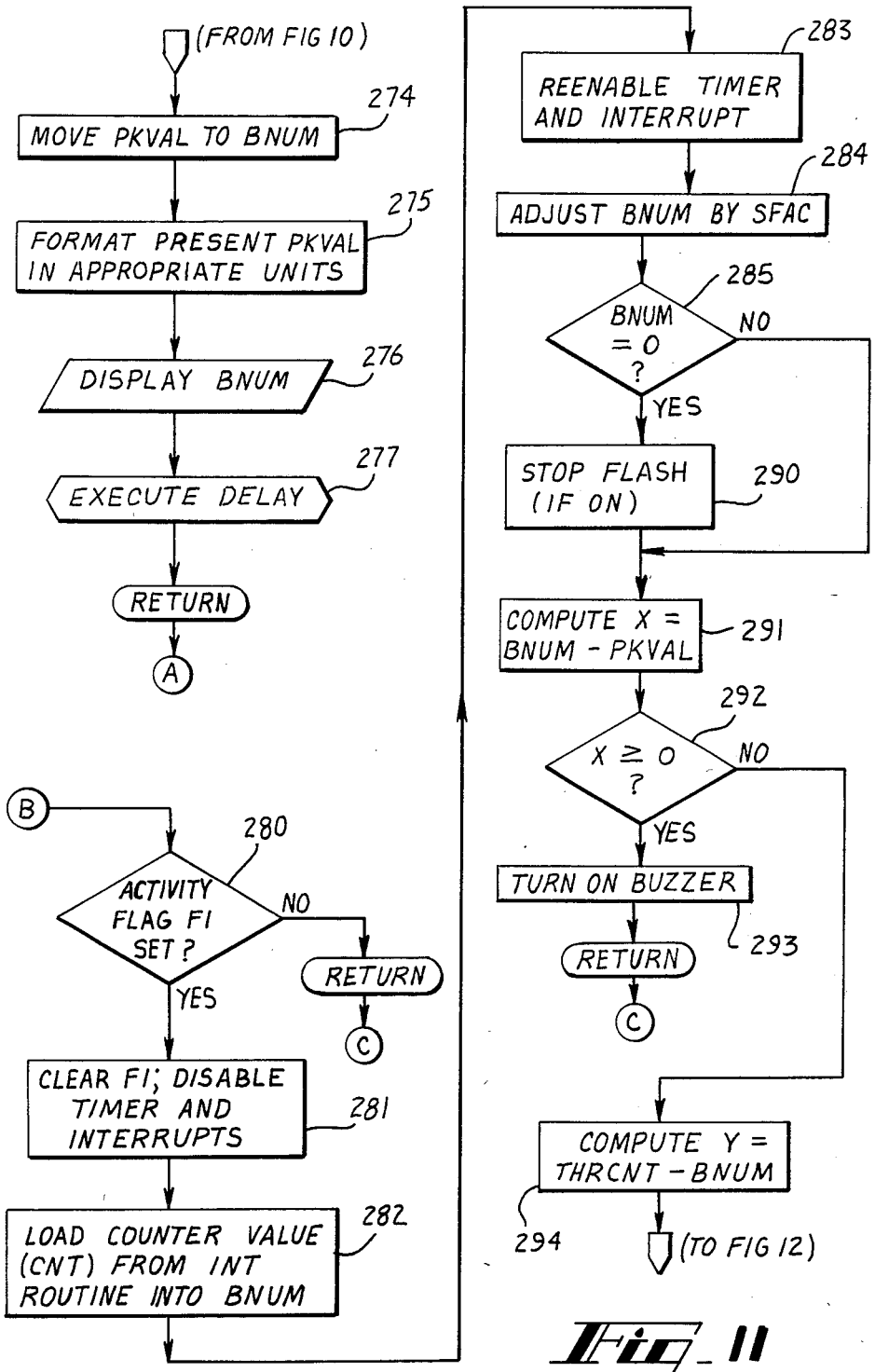

The main program begins at START block 200 in FIG. 9. Those skilled in the art will understand that the application of power by depression of ON/RST switch 30 causes power to be provided to microcomputer 60 and begins program operation. An initializing routine is first executed, which among other things resets the display to show zero torque. The first step of this routine at 201 is to turn the power on to the rest of the circuitry by a signal on line 106, to turn buzzer 145 off, and to disable interrupts. At 202, all registers are cleared in preparation for use.

At 203, the interrupt is enabled, allowing the microcomputer to respond to movement of the scale. Also, a power-on counter is reset at this point to an initial value, representing a predetermined time period, for timing purposes. In the preferred embodiment a predetermined time period of 45 seconds without activity causes the circuit to power itself off. Each pass of the program through a certain series of instructions in the auto timer routine of FIG. 13 causes the power-on counter to decrement; if this count reaches zero, there is indicated an absence of activity and power for the circuitry is switched off under software control by signal on line 107. The power-on counter is reset to the initial value during each subroutine which is called in response to some type of activity such as the actuation of a switch or the movement of the moving scale.

At 204, microcomputer 60 reads the calibration jumpers **100*a*–100*d* in order to obtain a correction factor (CORR) which is used to calibrate the displayed torque. At 205**, the correction factor CORR is converted into an adjusted scale factor (SFAC), which is a numerical multiplier used to convert the incremental count of pulses from the optical encoder into a value representative of torque.

The next step taken, shown at 210, is to load the default value for maximum allowable count (MAXCOUNT), which is a number representative of the maximum or end-of-scale reading of torque possible. In the preferred embodiment, this default value is 200 units. At 211, the MAXCOUNT is adjusted by the scale factor SFAC, and at 212 the scale-corrected MAXCOUNT is moved into a memory location designated as BNUM, which is a digital number representative of the present position of the moving scale.

In the preferred embodiment, when the preset mode is selected the display will flash when the applied torque reaches a "threshold" value below the preset torque value to signify the approach of the preset torque. When the preset torque value is reached, the flashing stops, and the audible alarm sounded. During initialization, the preset torque value is set to the default value. Thus, at 213 the scale-corrected MAXCOUNT is subtracted from 200 in order to obtain a threshold count.

At 220, the threshhold count is computed, and at 221 the peak value (PKVAL) is set to the same value as MAXCOUNT, i.e. two hundred units. PKVAL represents the maximum torque reading obtained during the current measurement, which in the peak hold mode is displayed continuously. By step 222, all initial parameters of the operation have been set, and the program is ready to enter the main operating loop. If any flashing of the display is present or if the buzzer is on, these are stopped at 222.

After the initializing routine, the main operating loop is entered at step 230, which is also identified by the marker C in FIG. 9. During this step, the power-on timer is enabled so that any absence of activity will result in decrementing of the power-on counter. At 231, the power-on timer is examined to determine if a zero count has been reached, indicating that forty-five seconds have elapsed since the last activity. If so, at 232 the power is turned off and the system will come to a halt. Pressing ON/RST is then required to reactivate the circuit.

If the power on timer has not reached zero, then from 231 program branches to 233 wherein the front panel routine (FPANEL) is called and executed. This routine is described in more detail in FIG. 15. This routine leads the control switches to determine if a switch has been actuated, indicating a change in mode, a change in the units displayed, or a desire to preset a new value for triggering the flashing or alarm.

Upon executing the FPANEL routine, the program status word (PSW) will contain information as to which switches have been actuated. At 234, the program status word is loaded, and is examined at 235 to determine what mode of operation has been selected. If the continuous (CONT) mode has been selected, the program goes to 240 and the CONT subroutine is called and executed. This subroutine is described in more detail in connection with FIG. 15. Upon exiting the CONT subroutine, if the continuous mode was selected, the program returns to point C at 230 and reenters the main loop.

If the continuous mode has not been selected at 235, the program goes to 241 and the determination is made whether the peak hold mode has been selected. If so, at 242 the peak hold (PKHOLD) subroutine is called and executed. In this subroutine, described in more detail in connection with FIG. 17, the largest torque value reached during the current operation is displayed. Upon exiting the PKHOLD subroutine, the program will return to point C at 230 and reenter the main operating loop.

If the peak hold mode has not been selected at 241, there is thus indicated the preset mode of operation wherein the instantaneous torque value is displayed, the display flashed as the preset torque is approached, and the alarm sounded when reached. At 250, upon the determination that the peak hold mode has not been selected, the instantaneous value as represented by PKVAL is loaded, at 251 this value is formatted in the appropriate units, and at 252 this value is output to display 113.

At 253, the switches 30–33 are read again to determine if one has been actuated. In particular, at 254 the inquiry is made whether the SET switch 32 has been pressed. If not, the program goes to point B at 280 described below. If the SET key has been pressed, at 255 the flashing of the display is stopped and the buzzer is turned off (if on), since the program will now enter a mode wherein a new value for triggering the flashing display and buzzer is to be set for the preset mode.

New values are preset in the following manner. In the disclosed embodiment, the microcomputer first cycles a digit on the display at a slow rate while the SET key is pressed, and then cycles the digit at a fast rate until the desired digit is approached, when operator should lift the key. The precise digit may then be selected by single depressions of the SET key. The displayed digit then represents the digit which the operator desires for that particular decimal position. The microcomputer cycles through each of the three digits until the number representing the desired torque value is displayed.

If the SET key is held depressed, upon entering block 256 a number designated FSCNT is loaded into a register. FSCNT represents the number of times the displayed digit is cycled at a slow rate, before shifting to a fast cycle rate. At 260, the SET key is examined again to determine if it is being held depressed. If not, the program goes to point B at 280 as described below. If the SET key is still pressed, the inquiry is made at 262 whether the variable FSCNT has been decremented to zero, indicating that the slow cycling of digits is completed. If FSCNT is not zero, then at 263 a slow delay time is loaded for use as a timer of the amount of time a particular digit is displayed. If FSCNT has reached zero, at 264 a fast delay time is loaded.

At 265, the variable FSCNT is decremented, providing a count of the number of times through this portion of the program.

At 270, all flags are cleared and the power on counter is reset since there has been an indication of activity. At 271, the peak value (PKVAL) is incremented, as is the threshold count (THRCNT), so that the displayed digits correspond to the stored counts. The value of PKVAL is compared to the maximum count MAXCOUNT at 272, and if they are equal, PKVAL is rolled over or reset back to zero and the threshhold count is reset to its initial value, since the maximum allowable displayed torque value for the device is 200.

If the peak value PKVAL is less than the maximum count MAXCOUNT, the value of PKVAL is moved to the variable BNUM in step 274, formatted in the appropriate units at 275, and displayed on display 113 at 276. Then, at 280, the appropriate fast or slow delay loaded in steps 263 or 264 is executed. The program then returns to point A at 260 wherein the inquiry is made whether the SET key is still pressed.

In the event that the SET key is not pressed at either of steps 254 or 260, the program goes to point B at 280, wherein the inquiry is made at step 280 whether the activity flag F1 is set. The activity flag F1 is set during the execution of each subroutine called in response to an indication of activity such as the depression of a switch or the movement of the moving scale. If the flag F1 is not set, the program returns to point C and reenters the main operating loop, there being indicated an absence of activity; the testing then begins anew for the expiry of the power-on timer and the reading of switches. If the flag F1 is set, there is indicated activity and at 281, the activity flag is cleared and the power-on timer and interrupts are disabled.

Since the program is now in a portion which is executed after a digital presetting operation, the next steps taken will be to determine whether the presently indicated torque value exceeds the preset or preprogrammed value, in which case the buzzer will be actuated (or the display flashed, if appropriate). At 282, the counter (CNT) representing the net movement of the moving scale is loaded into the variable BNUM, and at 283 the timer and interrupt are reenabled. The variable BNUM is adjusted by the scale factor SFAC at 284. At 285, BNUM is compared to zero and, if zero, at 290 the flashing of the display (if on) is stopped. If BNUM is not zero, or after the flashing is stopped, the PKVAL is subtracted from BNUM at 291, and at 292 the difference is compared to zero. If BNUM is greater than PKVAL, the present movement of the wrench indicates a torque which exceeds the preset value, in which case at 293 the buzzer alarm is sounded to provide an audible signal to the operator that the preset torque value has been reached. The program then returns to point C and reenters the main operating loop.

If at 292 the value of BNUM is less than the PKVAL, the program goes to 294 where the variable BNUM is subtracted from the threshold count THRCNT in order to determine whether the displayed value has surpassed the threshold. In the preferred embodiment, the display flashes when the displayed torque comes within a predetermined value, represented by THRCNT, of the preset value. At 295, the difference between THRCNT and BNUM is compared to zero, and if the difference is less than zero, BNUM has exceeded the threshhold and at 296 the display is flashed and the buzzer, if on, is turned off. The program then returns to the main operating loop at point C.

If the comparison at step 295 indicates that the displayed torque as represented by BNUM is less than the threshhold, at 297 the flash is turned off (if it had previously been turned on). Again, the program then returns to point C and reenters the main operating loop.

The main operating loop of the program employed in the preferred embodiment has now been described. There will now be described several subroutines which are used in the preferred embodiment to accomplish particular features of the present invention.

Figure 13:
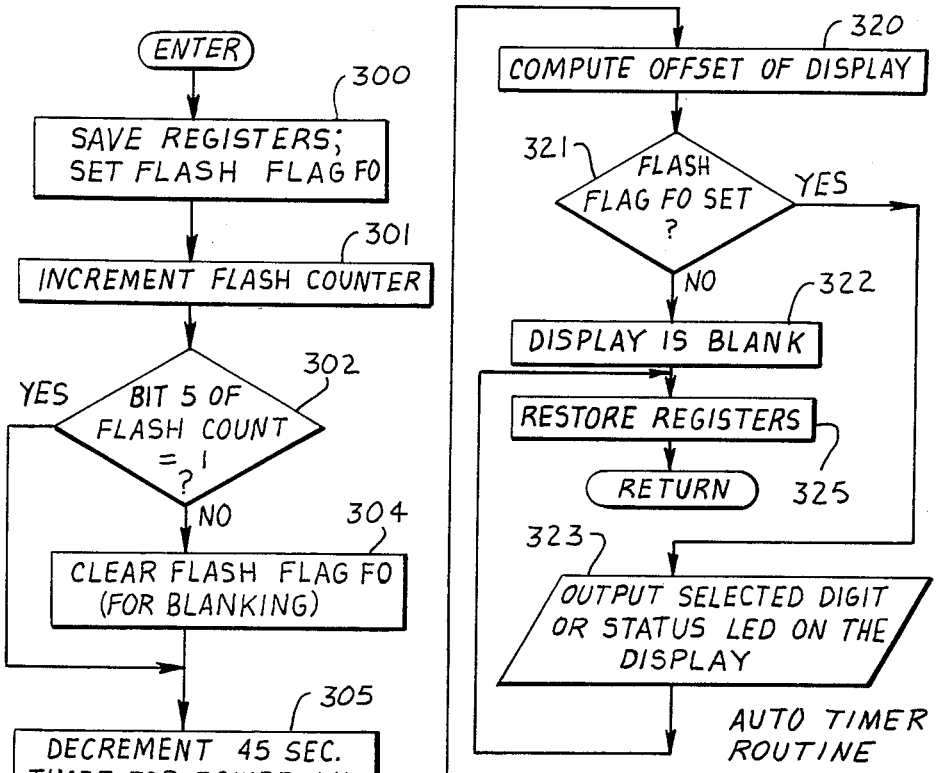
Figure 12:
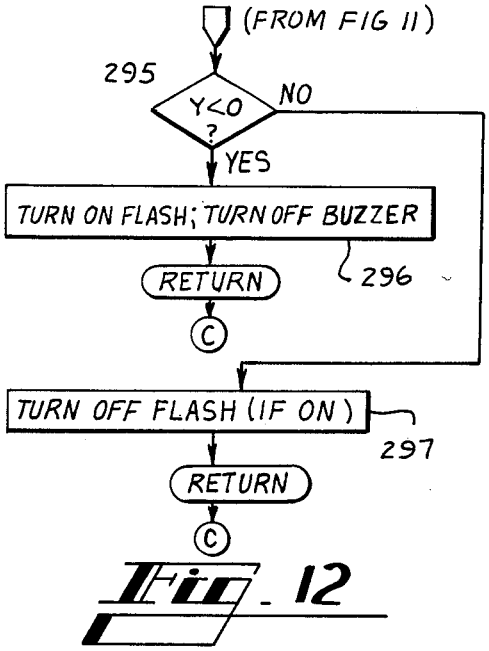

Turning now to FIG. 13, there is illustrated an auto timer routine which controls the flashing of the display, if appropriate, and the decrementing of the power-on timer. Those skilled in the art will appreciate that the type 8048 microcomputer used in the preferred embodiment includes an onboard timer which automatically generates a program interrupt at predetermined intervals. The routine illustrated in FIG. 13 is executed upon each interrupt caused by the onboard timer.

It should first be explained that the auto timer routine is operative to time multiplex the display, since all of the display elements (i.e. digits and status LED's) are driven by BCD decoder 110. On each pass through the routine, one particular digit (or status LED) is selected for display. The routine preferably executed at a frequency of about 30 hertz or greater to minimize flicker. Also, the routine flashes the digits, if appropriate, while ensuring that the status LED's are not flashed.

Entering the routine at 300, the first step taken is to save the numbers stored in the microcomputer's registers and to set the flash flag. At 301, a variable which is designated the flash counter is incremented for purposes of timing the on and off periods for the display flashing. At 302, bit five of the flash count is examined, and if not a one, the flash flag is cleared to indicate that the display should be blanked at 304. If bit five of the flash count is a one, then at 305 the power on timer is decremented, and at 306 the display is cleared.

The inquiry is made at step 310 whether the flash flag is set. A set flash flag indicates that a certain digit of the display is to be blanked on this pass through the auto timer routine. If the flash flag is not set, then at 312 the inquiry is made whether the flash bit in the program status word is on. The flash bit in the program status word will be set if the torque displayed exceeds the threshhold value such that the displayed digits should be flashed to warn the user that the preset value is being approached. If the flash bit is not on, then at 313 the flash flag is set so that the display will not be blanked when the applied torque is output.

If the flash flag is already set at 310, if the flash bit is on at 312, or after the setting of the flash flag at 313, the program goes to 320 wherein the display offset is computed. The display offset is a variable which is used to keep track of which of the digits (or status LED's) is to be displayed on this pass through the auto timer routine.

At 321, the inquiry is again made whether the flash flag is set. If not, the display is to be blanked and at 322 the entire display is blanked by a signal on line 133 to the blanking input BL of decoder 110.

If the flash flag is set, then at 323, the selected digit of the number representing the torque in BNUM is output to the display 113, or the selected LED's indicating the units and the mode are illuminated. After step 323 or after the blanking of the display at 322, as appropriate, the various registers are restored at 325, and the subroutine returns to the point of entry. It will now be appreciated that there has been described a routine for flashing the display if the program status word indicates that the displayed value of torque exceeds the preset value.

FIG. 14 illustrates the interrupt subroutine INT which is executed when the microcomputer 60 receives an interrupt signal on line 91 from the optical encoder. It will be recalled from the discussion above that an interrupt signal is provided upon each incremental movement of the movable scale 45. Entering the routine at 330, the first step taken is to disable the interrupt so that the subroutine may execute without disruption by a subsequent interrupt prior to the completion of the present pass through the subroutine. Since movement of the wrench has caused the production of pulses which cause the triggering of the present subroutine, the activity flag F1 is set to indicate that the torque wrench is active.

At 331, the power-on timer is reset in view of the indicated movement. At 332, the test pin T0 is read to determine the direction of movement, and at 333, the program inquires whether the direction of movement should cause an incrementing or a decrementing of the counter which represents the net movement of the wrench either clockwise or counterclockwise. For example, as torque is applied to a workpiece, the counter should increment or count up, and as the torque is relaxed, the counter should decrement to indicate that the amount of torque is decreasing until zero torque is reached wherein there is no detected movement.

If the direction of movement is up, at 340, the counter CNT is incremented. At 341, the count is compared to the most positive count reached (for purposes of operation in the peak hold mode), and if the present count exceeds the most positive count, the most positive count reached is replaced with the present count since there is indicated a new most positive count.

If the present count does not exceed the most positive count, or after the most positive count is updated, the program goes to step 343 wherein the interrupt is reenabled and reset with the signal INT CLR on line 92, and the subroutine returns.

If the direction of movement indicates that the count should be decremented since negative torque is being applied (or a positive torque is being released), at 349 the counter CNT is decremented. At 348, the count is compared to the most negative count reached, and if the present count is more negative than the most negative count, the most negative count is replaced with the present count.

After these operations, the interrupts are reenabled and the program returns.

Figure 15:
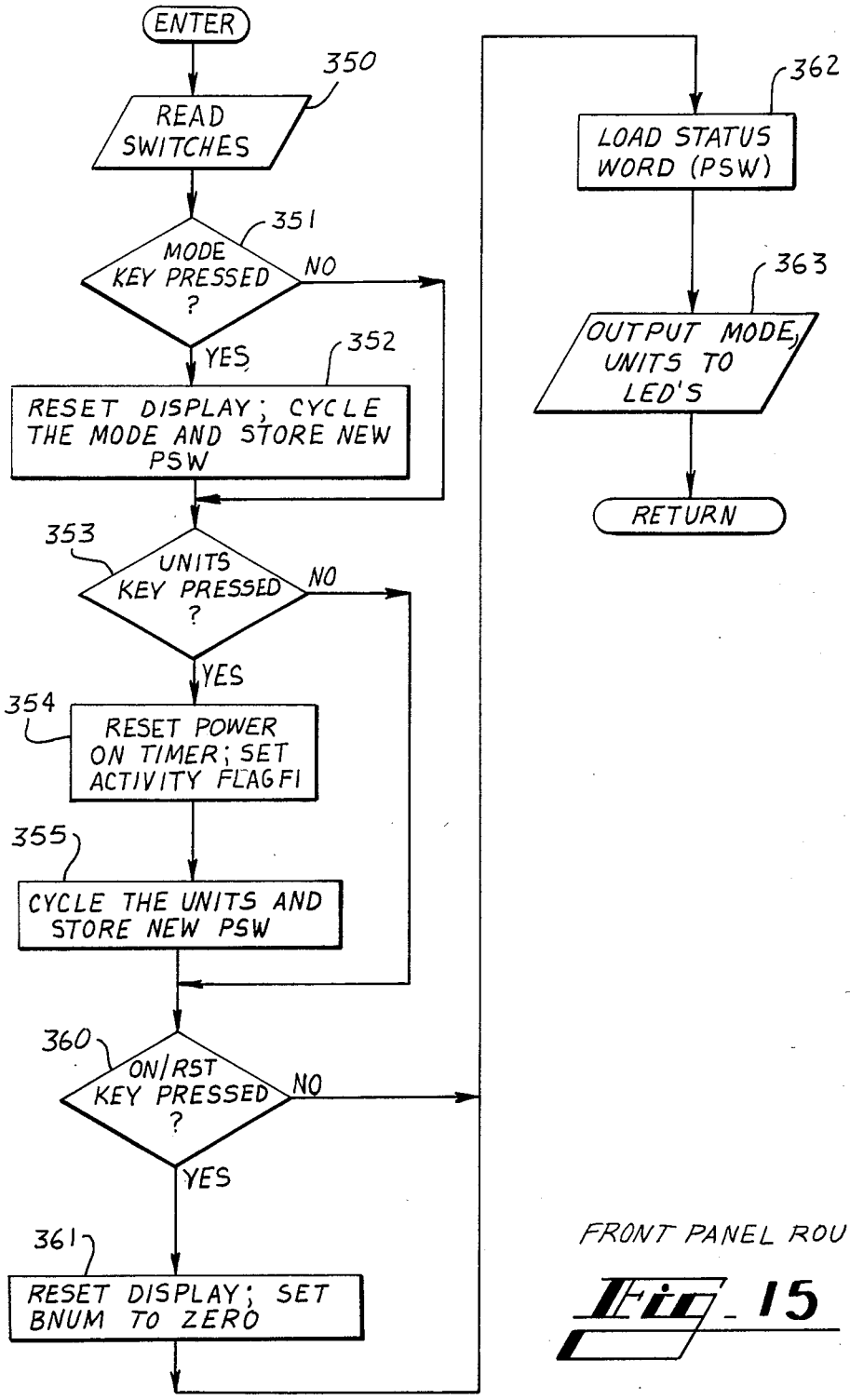

FIG. 15 illustrates the front panel subroutine FPANEL which is executed at step 233 in the main operating loop. Entering the routine at 350, microcomputer 60 first reads the data bus inputs DB0–DB7 to determine the status of the switches and calibration jumpers. At 351, if the MODE key 31 is pressed, the display is reset and a flag in the program status word (PSW) is set to indicate that a new mode is desired.

If the MODE key is not pressed, or after cycling the mode, at 353 the inquiry is made whether the UNITS key 33 is pressed. If so, at 354 the power on timer is reset, since activity has been indicated, and at 355 a bit in the program status word which represents the units displayed is cycled and the new program status word is stored.

If the UNITS key is not pressed, or after cycling the units if it has been pressed, the inquiry is made at 360 whether the reset key ON/RST is pressed. If so, at 361 the display is reset, the binary number representative of the applied torque is reset to zero, and the wrench will be ready to begin a new measurement with a zero torque displayed. Also, on each power up of the wrench, the initializing routine ensures that any movement detected by the optical encoder is relative to the null or rest position of the deflection beam (assuming of course that no torque is applied during power up). Advantageously, then, the disclosed embodiment is operative to compensate automatically for any distortion, offset due to repeated use in one direction, or hysteresis by treating the applied torque on power up or after activation of the ON/RST key, as a nominal or null torque.

If the reset key is not pressed, or after resetting the display, if appropriate, at 362 the new program status word is loaded, and the present status is output to the mode and units LED's. The subroutine then exits.

Figure 16:
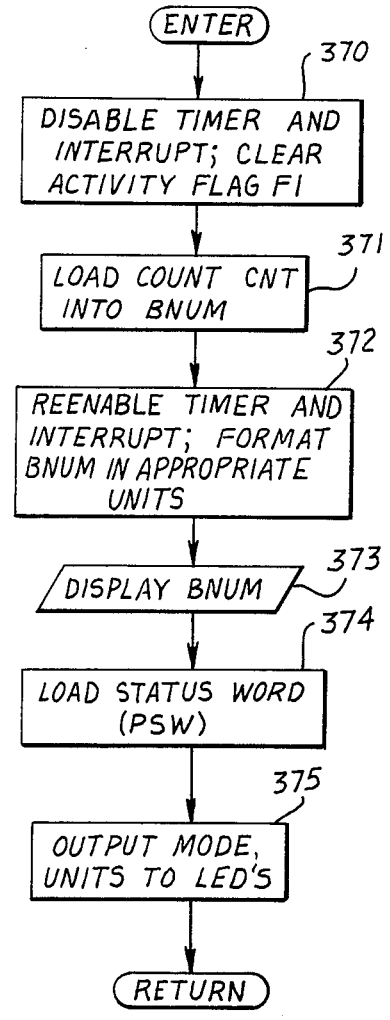

FIG. 16 illustrates the continuous mode subroutine CONT which is executed at block 240 in the main operating loop. Entering this subroutine at 370, the first step taken is to disable the onboard timer and the interrupt, and to clear the activity flag.

Since this routine will only execute when the wrench is in the continuous mode, the present count represents the net movement of the movable scale, and should be displayed. Thus, at 371, the count CNT maintained by the interrupt routine INT is transferred into the variable BNUM. At 372, the timer and interrupt are reenabled, and BNUM is formatted in the appropriate units. Then, at 373 the value of BNUM is displayed on the display. The program status word is loaded at 374, and at 375 the presently selected mode and units are displayed on the mode and units LED's. The subroutine then exits. It will be appreciated that in the continuous mode there will always be displayed on display 113 the value of the net movement of the movable scale as represented by the value of the count CNT.

Figure 17:
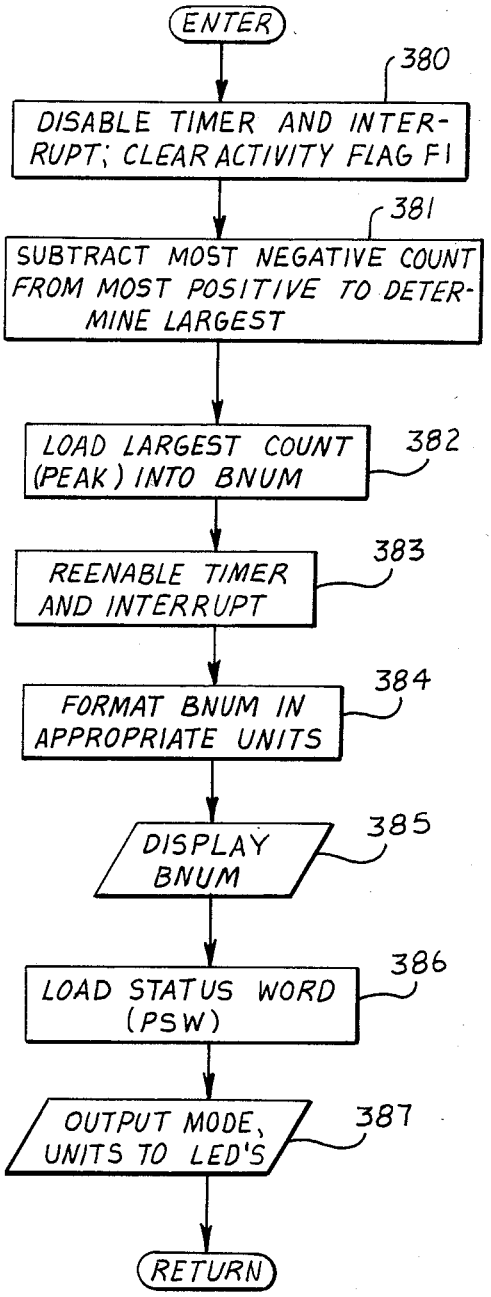

FIG. 17 is the peak hold mode subroutine PKHOLD which is executed at step 242 in the main operating loop if the wrench is in the peak hold mode. This routine executes when only the most positive or the mold negative value of torque is to be displayed and held until replaced by a higher value.

Entering this routine at 380, the first step taken is to disable the onboard timer and interrupt to prevent disruption, and to clear the activity flag F1. At 381, the most negative count is subtracted from the most positive to determine which of these counts is the largest. At 382, the largest of these counts is loaded into the variable BNUM, since this value represents the largest torque applied during the present operation. At 383, the timer and interrupt are reenabled, and BNUM is formatted in the appropriate units at 384. Then at 385, BNUM is output to the display. The program status word is loaded at 386, and the presently selected mode and units are displayed on the mode and units LED's at 387. The subroutine then exits.

The preferred embodiment of the present invention has been disclosed by way of example and it will be understood that other modifications and alterations may occur to those skilled in the art without departing from the scope and the spirit of the appended claims.

We claim:

1. An indicating torque wrench, comprising:

a handle;

means for converting a force applied to said handle into a torque applied to a workpiece;

displacement means including a fixed portion and a movable portion responsive to move a predetermined distance with respect to said fixed portion upon the application of a predetermined force to said handle;

optical encoder displacement measuring means responsive to movement between said fixed portion and said movable portion of said displacement means for providing a plurality of digital displacement signals related to said predetermined distance, each one of said digital displacement signals representing a predetermined incremental amount of displacement between said fixed portion and said movable portion of said displacement means;

computing means responsive to said digital displacement signals for converting said displacement signals into a torque signal having a magnitude related to the amount of torque applied to the workpiece; and digital display means for displaying a visual representation of said torque signal.

2. The torque wrench of claim 1, wherein said fixed portion of said displacement means comprises an elongate shaft having a high modulus of elasticity, and wherein said movable portion comprises an elongate rod affixed at one end to said converting means and having a second free end.

3. The torque wrench of claim 2, wherein said shaft is a hollow tubular shaft, and wherein said rod is contained within said shaft.

4. The torque wrench of claim 1, wherein said force converting means comprises a torsion bar, wherein said fixed portion of said displacement means comprises an elongate shaft having a high torsional modulus of elasticity affixed to said torsion bar, and wherein said movable portion comprises an elongate rod affixed at one end to said torsion bar and having a second free end movable relative to said shaft.

5. The torque wrench of claim 1, wherein said force converting means comprises a cantilever beam, wherein said fixed portion of said displacement means comprises an elongate shaft having a high modulus of elasticity attached to said cantilever beam, and wherein said movable portion comprises an elongate rod affixed at one end to said cantilever beam and having a second free end movable relative to said shaft.

6. The torque wrench of claim 1, wherein said force converting means comprises an elongate bending beam having a high modulus of elasticity supported within a housing, wherein said fixed portion of said displacement means comprises one end of said bending beam, and wherein said movable portion comprises an elongate rod affixed at one end to the other end of said bending beam and having a second free end movable relative to said fixed portion.

7. The torque wrench of claim 1, wherein said force converting means comprises an elongate torsion bar having a high torsional modulus of elasticity, wherein said fixed portion of said displacement means comprises an indicator rod affixed to said torsion bar, and wherein said movable portion comprises an elongate housing containing said torsion bar and movable relative to said indicator rod.

8. The torque wrench of claim 1, further comprising first and second operator alarm means for providing a perceptible signal to the operator of the wrench, and wherein said computing means is operative to actuate said first alarm means as said torque signal exceeds a threshold torque value, and is thereafter operative to actuate said second alarm means when said torque signal exceeds a predetermined torque value.

9. The torque wrench of claim 8, wherein said display means is operative to flash on and off, and wherein said computing means is operative to flash said display means as said first alarm means.

10. The torque wrench of claim 8, wherein said second alarm means comprises an audible alarm.

11. The torque wrench of claim 1, wherein said displacement measuring means comprises:

a substantially transparent fixed reticle having a grating pattern thereon and affixed to said fixed portion of said displacement means:

a second substantially transparent movable reticle having a grating pattern thereon and affixed to said movable portion in overlapping relationship to said fixed reticle;

a light source mounted to illuminate both said fixed reticle and said movable reticle; and a light detector mounted to detect light emitted by said light source and passing through both said fixed reticle and said movable reticle, the grating pattern of said fixed reticle and said movable reticle producing alternating opaque and transparent areas in the light path between said light source and said light detector, said light detector providing displacement increment pulses as said displacement signals upon the detection of said opaque and transparent areas.

12. The torque wrench of claim 1, further comprising direction detection means for detecting the direction of movement between said fixed portion and said movable portion of said displacement means and for providing a direction signal, and wherein said computing means is responsive to said direction signal to increase said torque signal when the applied torque is increasing and to decrease said torque signal when the applied torque is decreasing.

13. The torque wrench of claim 1, further comprising unit selection switch means, and wherein said computing means is responsive to said switch means to provide said torque signal in different preselected systems of units.

14. The torque wrench of claim 1, further comprising calibration memory means for storing a correction signal related to the error between a known applied torque and the amount of torque indicated by said computing means in response to said known torque.

15. The torque wrench of claim 14, wherein said computing means is responsive to correct said torque signal based upon said correction signal prior to transmitting said torque signal to said display means.

16. The torque wrench of claim 1, wherein said computing means is operative to provide a torque signal corresponding to zero torque upon each occurrence of a reset signal.

17. The torque wrench of claim 16, further comprising operator reset switch means, and wherein said reset switch means provides said reset signal upon actuation by an operator.

18. The torque wrench of claim 16, further comprising power on reset means for initializing said computing means upon the connection of power, and wherein said reset means provides said reset signal.

19. An indicating torque wrench, comprising:

an elongate deflecting beam having a high modulus of elasticity and including a handle at one end;

torque transmitting means mounted at the other end of said deflecting beam for converting a force exerted upon said handle into a torque and for transmitting said torque to a workpiece;

a cantilever indicating beam affixed at a first end to said deflecting beam and supported for movement in response to said force, and having a second free end;

optical encoder deflection sensing means mounted for detecting the relative movement between said deflecting beam and said indicating beam and for providing a plurality of digital deflection signals related to said relative movement, each one of said digital deflection signals representing a predetermined incremental amount of deflection;

digital signal processing means responsive to said digital deflection signals for converting said deflection signals into a torque signal having a magnitude related to the amount of torque applied to the workpiece; and display means for displaying a visual representation of said torque signal.

20. In an indicating torque wrench including means for providing a torque to a workpiece, a work-engaging head, and indicating means for displaying the relative movement between an elastic deforming member and a fixed member in response to a force exerted on said elastic member, the improvement wherein said indicating means comprises:

position sensing means for detecting a first relative displacement between said elastic member and said fixed member when no torque is applied to the workpiece and for providing a first position signal, and further for detecting a second relative displacement between said elastic member and said fixed member when a torque is applied to the workpiece and for providing a second position signal, signal processing means responsive to treat said first position signal as a nominal null torque and further responsive to said first and said second position signals for converting said signals into a torque signal based upon the difference between said first and said second relative displacements, and display means for displaying a visual representation of said torque signal.

21. The improvement of claim 20, further comprising selectively operator actuable reset means for causing said signal processing means to treat said first position signal as representing a nominal null torque upon actuation by the operator.

22. In an indicating torque wrench including means operative for providing torque to a workpiece, means for detecting the torque and for providing torque signals related to the amount of torque applied, and display means responsive to display a visual representation of said torque signals, the improvement comprising:

means for selecting one of a plurality of predetermined correction signals, each one of said correction signals being related to a predetermined increment of error between the actual amount of torque as measured against a known torque at a first, calibration time and the amount of torque indicated by said detecting means and represented by said torque signals at said calibration time;

nonvolatile memory means for retrievably storing said selected one of said correction signals; and calibration means responsive to said correction signal stored in said memory means for correcting said visual representation of said torque signals displayed by said display means at a second torque-applying time.

23. An indicating torque wrench, comprising:

a handle;

means for converting a force applied to said handle into a torque applied to a workpiece;

displacement means including a fixed portion and a movable portion responsive to move a predetermined distance with respect to said fixed portion upon the application of a predetermined force to said handle;

displacement measuring means responsive to movement between said fixed portion and said movable portion of said displacement means for providing displacement signals related to said predetermined distance;

computing means responsive to said displacement signals for converting said displacement signals into a torque signal having a magnitude related to the amount of torque applied to the workpiece;

digital display means for displaying a visual representation of said torque signal; and first and second operator alarm means for providing a perceptible signal to the operator of the wrench, wherein said computing means is operative to actuate said first alarm means as said torque signal exceeds a threshold torque value, and is thereafter operative to actuate said second alarm means when said torque signal exceeds a predetermined torque value.

24. The torque wrench of claim 23, wherein said display means is operative to flash on and off, and wherein said computing means is operative to flash said display means as said first alarm means.

25. The torque wrench of claim 23, wherein said second alarm means comprises an audible alarm.

26. An indicating torque wrench, comprising:

a handle;

means for converting a force applied to said handle into a torque applied to a workpiece;

displacement means including a fixed portion and a movable portion responsive to move a predetermined distance with respect to said fixed portion upon the application of a predetermined force to said handle;

displacement measuring means responsive to movement between said fixed portion and said movable portion of said displacement means for providing displacement signals related to said predetermined distance, comprising:

a substantially transparent fixed reticle having a grating pattern thereon and affixed to said fixed portion of said displacement means, a second substantially transparent movable reticle having a grating pattern thereon and affixed to said movable portion in overlapping relationship to said fixed reticle, a light source mounted to illuminate both said fixed reticle and said movable reticle, and a light detector mounted to detect light emitted by said light source and passing through both said fixed reticle and said movable reticle, the grating pattern of said fixed reticle and said movable reticle producing alternating opaque and transparent areas in the light path between said light source and said light detector, said light detector providing displacement increment pulses as said displacement signals upon the detection of said opaque and transparent areas;

computing means responsive to said displacement signals for converting said displacement signals into a torque signal having a magnitude related to the amount of torque applied to the workpiece; and digital display means for displaying a visual representation of said torque signal.

27. An indicating torque wrench, comprising:

a handle;

means for converting a force applied to said handle into a torque applied to a workpiece;

displacement means including a fixed portion and a movable portion responsive to move a predetermined distance with respect to said fixed portion upon the application of a predetermined force to said handle;

displacement measuring means responsive to movement between said fixed portion and said movable portion of said displacement means for providing displacement signals related to said predetermined distance;

computing means responsive to said displacement signals for converting said displacement signals into a torque signal having a magnitude related to the amount of torque applied to the workpiece;

digital display means for displaying a visual representation of said torque signal; and direction detection means for detecting the direction of movement between said fixed portion and said movable portion of said displacement means and for providing a direction signal, said computing means being responsive to said direction signal to increase said torque signal when the applied torque is increasing and to decrease said torque signal when the applied torque is decreasing.

28. An indicating torque wrench, comprising:

a handle;

means for converting a force applied to said handle into a torque applied to a workpiece;

displacement means including a fixed portion and a movable portion responsive to move a predetermined distance with respect to said fixed portion upon the application of a predetermined force to said handle;

displacement measuring means responsive to movement between said fixed portion and said movable portion of said displacement means for providing displacement signals related to said predetermined distance;

computing means responsive to said displacement signals for converting said displacement signals into a torque signal having a magnitude related to the amount of torque applied to the workpiece;

digital display means for displaying a visual representation of said torque signal; and unit selection switch means, said computing means being responsive to said switch means to provide said torque signal on said display means in different preselected systems of units.

29. An indicating torque wrench, comprising:

a handle;

means for converting a force applied to said handle into a torque applied to a workpiece;

displacement means including a fixed portion and a movable portion responsive to move a predetermined distance with respect to said fixed portion upon the application of a predetermined force to said handle;

displacement measuring means responsive to movement between said fixed portion and said movable portion of said displacement means for providing displacement signals related to said predetermined distance;

computing means responsive to said displacement signals for converting said displacement signals into a torque signal having a magnitude related to the amount of torque applied to the workpiece;

digital display means for displaying a visual representation of said torque signal; and calibration memory means for storing a correction signal related to the error between a known applied torque and the amount of torque indicated by said computing means in response to said known torque.

30. The torque wrench of claim 29, wherein said computing means is responsive to correct said torque signal based upon said correction signal prior to transmitting said torque signal to said display means.

31. An indicating torque wrench, comprising:

a handle;

means for converting a force applied to said handle into a torque applied to a workpiece;

displacement means including a fixed portion and a movable portion responsive to move a predetermined distance with respect to said fixed portion upon the application of a predetermined force to said handle;

displacement measuring means responsive to movement between said fixed portion and said movable portion of said displacement means for providing displacement signals related to said predetermined distance;

computing means responsive to said displacement signals for converting said displacement signals into a torque signal having a magnitude related to the amount of torque applied to the workpiece, said computing means being operative to provide said torque signal as corresponding to zero torque upon each occurrence of a reset signal; and digital display means for displaying a visual representation of said torque signal.

32. The torque wrench of claim 31, further comprising operator reset switch means, and wherein said reset switch means provides said reset signal upon actuation by an operator.

33. The torque wrench of claim 31, further comprising power on reset means for initializing said computing means upon the connection of power, and wherein said reset means provides said reset signal.

* * * * *